United States Patent [19]

Sarwe

[11] Patent Number: 4,823,719

[45] Date of Patent: Apr. 25, 1989

[54] SEMISUBMERSIBLE VESSEL HAVING MEANS FOR INCREASING STABILITY AND DAMPEN MOTION

[75] Inventor: Anders Sarwe, Göteborg, Sweden

[73] Assignee: Gotaverken Arendel AB, Sweden

[21] Appl. No.: 146,282

[22] Filed: Jan. 20, 1988

[30] Foreign Application Priority Data

Jan. 23, 1987 [SE] Sweden ..... 8700263

[51] Int. Cl.[4] ..... B63B 39/06

[52] U.S. Cl. ..... 114/126; 114/265

[58] Field of Search ..... 114/256, 264, 265, 121, 114/124, 126

[56] References Cited

U.S. PATENT DOCUMENTS 3,207,110 9/1965 Laborde et al. ..... 114/265
3,289,419 12/1966 McGowen, Jr. ..... 114/264 X
3,986,471 10/1976 Haselton ..... 114/265

FOREIGN PATENT DOCUMENTS 831103 3/1983 Norway .
433832 6/1984 Sweden .
8504909 10/1985 Sweden .

*Primary Examiner*—Sherman D. Basinger
*Attorney, Agent, or Firm*—Wegner & Bretschneider

[57] ABSTRACT

A semisubmersible, stationary positioned vessel for offshore work, e.g. development of oil and gas fields and having a device for, in operational condition, increasing stability and dampen motion. The vessel has at least one submerged body as well as a number of legs supported thereby for carrying a work deck at a secure level above the operational water line. The waterline area of the vessel is increased at at least some of the legs. The vessel also comprises a device for rigidly connecting at least one horizontal plate below the submerged body. The area of the plate and the vertical distance from the body determining the volume of the added mass of water vacillating well below the water line following the elastic movements of the vessel.

6 Claims, 2 Drawing Sheets

SEMISUBMERSIBLE VESSEL HAVING MEANS FOR INCREASING STABILITY AND DAMPEN MOTION

FIELD OF THE INVENTION

The present invention relates to a semisubmersible vessel having means for holding the vessel stationary during development of an oil or gas field and comprising at least one submerged body as well as a number of legs supported thereby for carrying a work deck at a secure level above the operational waterline.

BACKGROUND OF THE INVENTION

Catenary anchored or dynamically positioned vessels for development of oil and gas fields must be designed for good stability during severe wind and wave conditions, wherein minimal movements during different work operations is a necessity, together with security, availability and good housing conditions on these vessels. A design having increased stability and reduced motions also reduces the loads on the anchoring means.

The economical aspects of these kinds of vessels amounts to the strive towards largest possibly pay load on the work deck, i.e. equipment, machines and supplies within the decided concept. Normally an increase in pay load results in increased motion of the vessel. Therefore, when the pay load near to the work deck is increased, usually also the complete steel structure must be amplified. These difficulties present to the designer the task of either designing a new vessel or modernizing an existing vessel.

SUMMARY OF THE INVENTION

The object of the invention is therefore to, in a simple and cost-effective way, considerably increase stability and at the same time reduce motion sensitivity during operational condition, for a semisubmersible, elastically anchored vessel according to the preamble of claim 1.

According to the invention, means are arranged for increasing the waterline area of at least some of the legs as well as means for rigidly connecting at least one horizontal plate below said submerged body, the area of the plate and the vertical distance from the body determining the volume of the added mass of water vacillating well below the water line following the elastic movements of the vessel.

According to one preferable embodiment of the invention, each plate is designed as a closed, fully or partly ballastable shell.

Each plate is preferably connected to its respective submerged body via vertical, horizontal and diagonal beams or rods.

Further, the the plates preferably are horizontally concave, as seen in the longitudinal direction of said bodies.

BRIEF DESCRIPTION OF THE DRAWINGS

An embodiment of the invention will now be described in detail with reference to the accompanying drawings, in which.

DESCRIPTION OF A PREFERRED EMBODIMENT

Figure 1:
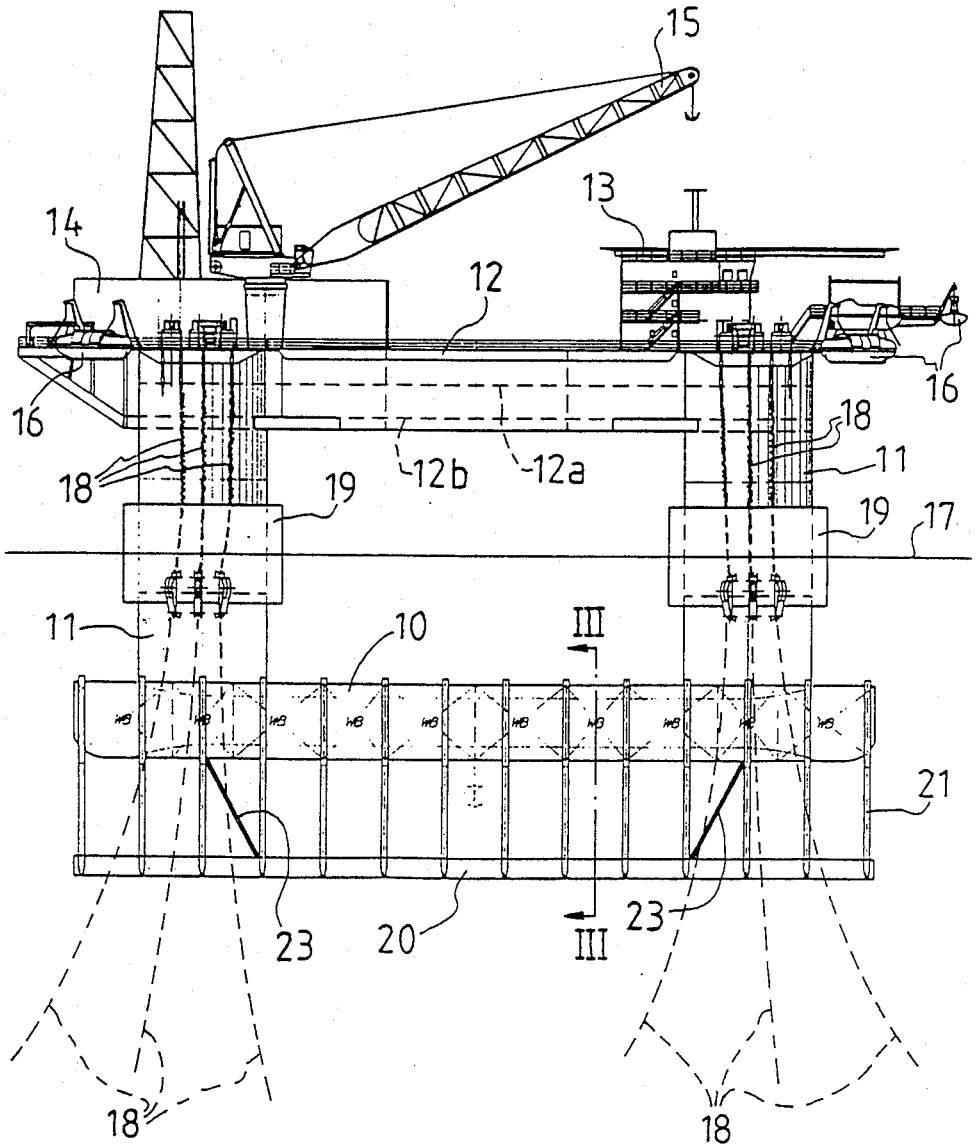
FIG. 1 is a side view showing an off-shore vessel, which is designed according to the invention.
Figure 2:
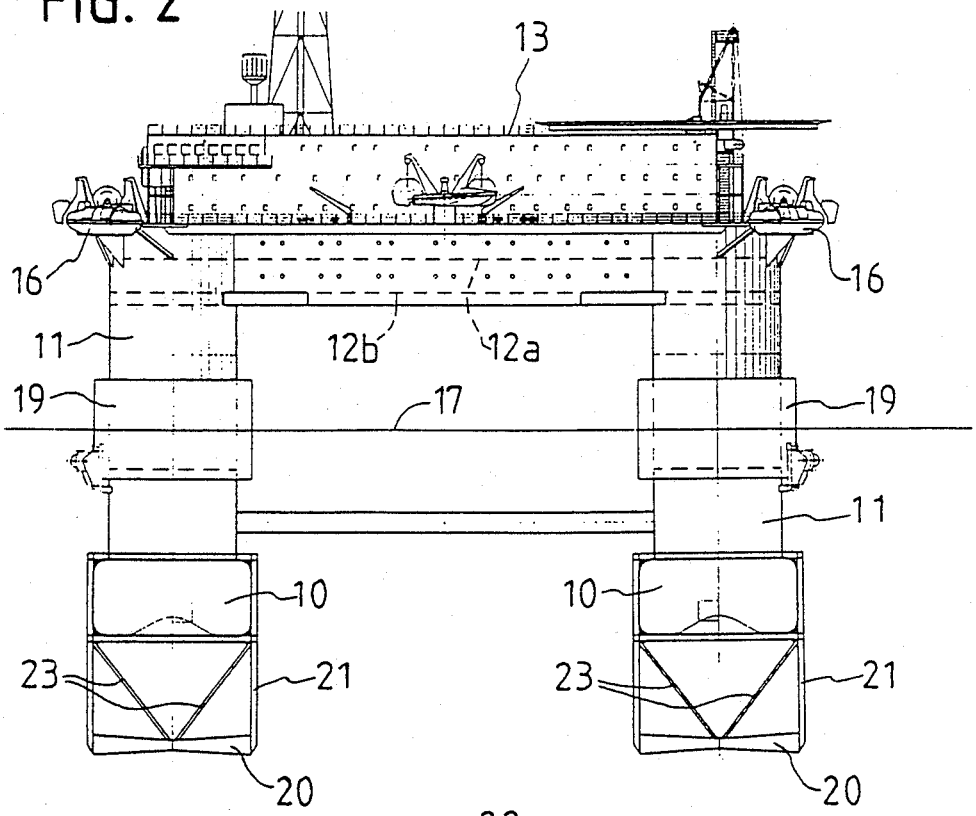
FIG. 2 is a front view of the vessel in FIG. 1.

The vessel in the drawings has two parallel submerged bodies 10 and four vertical legs 11 carrying a work deck 12 with living quarters 13, a processing plant 14 for the production of oil and gas, cranes 15 and life boats 16. The work deck 12 forms a box structure having two lower decks **12*a*, 12*b*, e.g. enclosing work shops and stores. This considerable deck load is carried by the submerged bodies and those parts of the legs 11 which are below the operational water line 17. According to the art, the bodies 10 are predominantly ballasted, in order to give the vessel good stability. Anchor chains 18** run down along the outside of the legs and further to anchors at the sea bottom.

Figure 3:
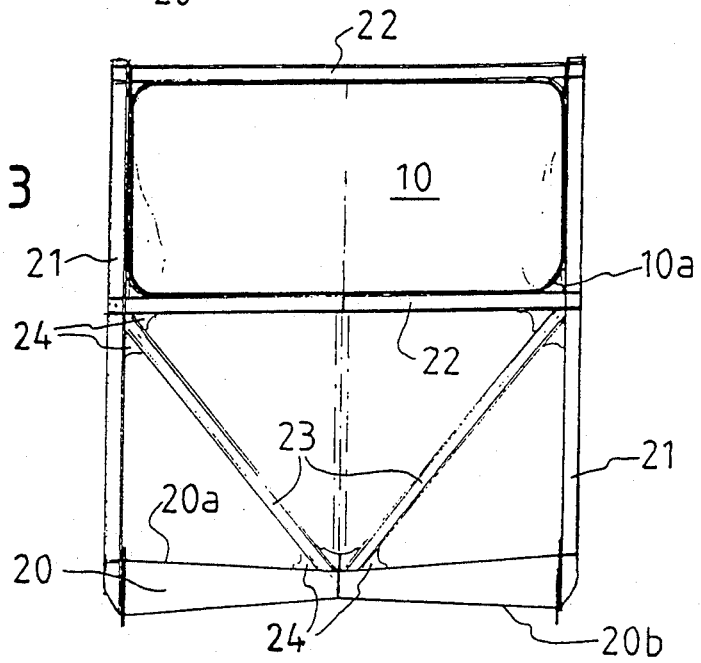
FIG. 3 is a vertical section along the line III—III in FIG. 1.

In order to enable a large deck load, without worsening motion conditions, two alterations have been made to the vessel; fenders 19 have been mounted on the support legs 11 in the area of the operational water line 17, said fenders increasing the water line area; and a horizontal plate 20 has been mounted on each of the subsurface bodies 10, at a vertical distance from the underside 10a of the respective subsurface body. The plates 20 are rigidly connected to its respective subsurface body via vertical and diagonal beams 21 and 23 respectively. This mounting system of the plates is rigid and comparatively light and inexpensive to build. From FIG. 3 it is evident that the plates are designed as closed shells, which during mounting, preferably are ballasted so that they have a weight corresponding to the weight of the water displaced by each plate, and they are completely filled by water after mounting, so that they are not affected by the ambient water pressure.

It is known in the art that fenders enlarging area in the water line enhance resistance, i.e. dampen heave, roll and pitch, in low wave trains in irregular sea. The disadvantage with these fenders is that they normally lead to reduced natural oscillation cycle periods and increase movement in high wave trains in irregular sea. Plates are also known from other applications where they have been used for reduction of wave induced vessel motion. In the combination according to the invention, however, a previously not known technical effect is achieved, namely that movement is reduced at low wave trains while damping at high wave trains at the same time is increased in all directions and while the natural oscillation cycle periods are maintained at a safe level.

As a result of the considerably enhanced stability, the deck load may be substantially increased. It should be observed that the weight of the steel components added according to the invention, normally is much less than the pay load which may be added to the work deck. It is therefore possible to move the centre of gravity upwards in the structure through the means according to the invention.

To increase damping, the plates 20 in the described embodiment are designed with oversides **20*a* and undersides 20*b* which camber towards their longitudinal centre. Since the movements of the vessel in the water thus will be small, the anchoring system will not have to be amplified on account of movement, which is normally always done according to the state of the art, when pay load is increased. Besides, the steel structure does not have to be strengthened since the increased water line area and the plates 20** preferably are so dimensioned, that they compensate each other with reference to global loads, i.e. the loads which normally substantially rate the deck box and beams.

Since damping is increased, so that the phase shift in the natural oscillation cycle period is reduced, it is possible to reduce the distance between the work deck and the sea surface.

Further, an increase is obtained in the radius of inertia in the structure.

The following table show a comparison between a conventional semisubmersible platform 1, and a corresponding platform 2 which has been modified according to the invention. It will be clear from this table, that all motion response values have been improved at the modified platform 2, in spite of a more than doubled deck payload.

| PLATFORM | 1 | 2 |
|---|---|---|
| Displacement ($m^3$) | 25 300 | 29 920 |
| Deck carrying capacity (tonnes) | 2 120 | 7 020 |
| Fender volume ($m^3$) | 0 | 1225.5 |
| Plate volume ($m^3$) | 0 | 3383.5 |
| = GM (m) | 2.1 | 2.1 |
| + BM (m) | 15.68 | 19.61 |
| − KG (m) | 20.0 | 22.5 |
| + KB (m) | 6.58 | 5.06 |
| Water line area ($m^2$) | 523 | 768 |
| Period of natural resonance, heave (sek) | 21.66 | 21.45 |
| Period of natural resonance, pitch (sek) | 48.06 | 56.9 |
| Period of natural resonance, heave (sek) | 63.1 | 71.2 |
| Added mass, heave (−) | 1.41 | 1.93 |
| Added mass, pitch (−) | 0.046 | 0.076 |
| Added mass, roll (−) | 0.120 | 0.162 |
| Radius of inertia, pitch (m) | 27.3 | 30.5 |
| Radius of inertia, roll (m) | 29.6 | 32.0 |
| Heave response $T_z$ = 10 sek (m/m) | 0.44 | 0.36 |
| Pitch response $T_z$ = 10 sek (°/m) | 0.32 | 0.22 |
| Roll response $T_z$ = 10 sek (°/m) | 0.47 | 0.35 |

The means according to the invention may be applied both to newly designed vessels and when old designs are upgraded, wherein a pay load capacity is obtained which corresponds to substantially larger and more expensive vessel.

The invention is not limited to the above described embodiment, but several modifications are possible within the scope of the embodying claims. For example, the plates do not have to run along the entire subsurface body, but may comprise two plate sections, one at each end of the body. The means for mounting the plates at the subsurface bodies can be designed differently. The invention may be applied on vessels having different configuration than is disclosed above, e.g. with more or less support legs and differently designed subsurface bodies. Thus, the vessel may have a frame formed pontoon, wherein plates 20 may be mounted at each of the four corners. The means according to the invention may be applied to all semisubmersible vessels, e.g. platforms for accommodation, drilling or production. The increased water line area may be obtained differently than shown in the embodiment, e.g. through the addition of more support legs.

What we claim:

1. A semisubmersible vessel having means for holding the vessel stationary during development of an oil or gas field and comprising:

at least one submerged body as well as a number of legs supported thereby for carrying a work deck at a secure level above the operational waterline, means for increasing the waterline area of at least some of the legs, and means for rigidly connecting at least one horizontal plate below said submerged body, the area of the plate times the vertical distance from the body determining the volume of the mass of water vacillating well below the water line following the elastic movements of the vessel.

2. A vessel according to claim 1, wherein each plate is designed as a closed, fully or partly ballastable shell.

3. A vessel according to claim 1, wherein each plate is connected to its respective submerged body via vertical, horizontal and diagonal beams or rods.

4. A vessel according to claim 3, wherein the plate is horizontally concave, as seen in the longitudinal direction of said at least one submerged body.

5. A vessel according to claim 1, wherein the plate is horizontally concave, as seen in the longitudinal direction of said at least one submerged body.

6. A vessel according to claim 5, wherein each plate is connected to its respective submerged body via vertical, horizontal and diagonal beams or rods.

* * * * *